United States Patent [19]

Van Eeck

[11] 4,030,455

[45] June 21, 1977

[54] ANTIPOLLUTION CARBURETOR DEVICE FOR INTERNAL COMBUSTION ENGINES

[76] Inventor: Philippe F. Van Eeck, 11827 Kearsarge St., Los Angeles, Calif. 90049

[22] Filed: Sept. 3, 1974

[21] Appl. No.: 502,716

Related U.S. Application Data

[63] Continuation-in-part of Ser. No. 366,270, June 4, 1973, abandoned.

[52] U.S. Cl. ..... 123/25 E; 123/1 A; 123/3; 123/25 N

[51] Int. Cl.[2] ..... F02D 19/12

[58] Field of Search ..... 123/25 B, 25 D, 25 N, 123/25 R, 119 E, 1 A, 3, DIG. 12, 25 E, 25 F, 25 G, 25 H; 261/18 A

[56] References Cited

UNITED STATES PATENTS

| | | | |
|---|---|---|---|
| 1,488,054 | 3/1924 | Muzzy | 123/25 B |
| 1,876,879 | 9/1932 | Drabold | 123/119 E |
| 3,450,116 | 6/1969 | Knight et al. | 123/25 H X |
| 3,537,434 | 11/1970 | Herpin | 123/198 |
| 3,648,668 | 3/1972 | Pacheeo | 123/1 A |
| 3,818,875 | 6/1974 | Phillips et al. | 123/25 E |

*Primary Examiner*—Carroll B. Dority, Jr.
*Assistant Examiner*—Ira S. Lazarus
*Attorney, Agent, or Firm*—Lewis B. Sternfels

[57] ABSTRACT

Water, with chemical additives and metallic salts therein, is injected into an internal combustion engine, such as for automobiles, to reduce production of carbon monoxide and by reducing the amounts of oxides of nitrogen. Metallic salts may be added to tap water by use of an electrolysis cell connected to the engine's battery or alternator.

23 Claims, 2 Drawing Figures

Fig. 1.
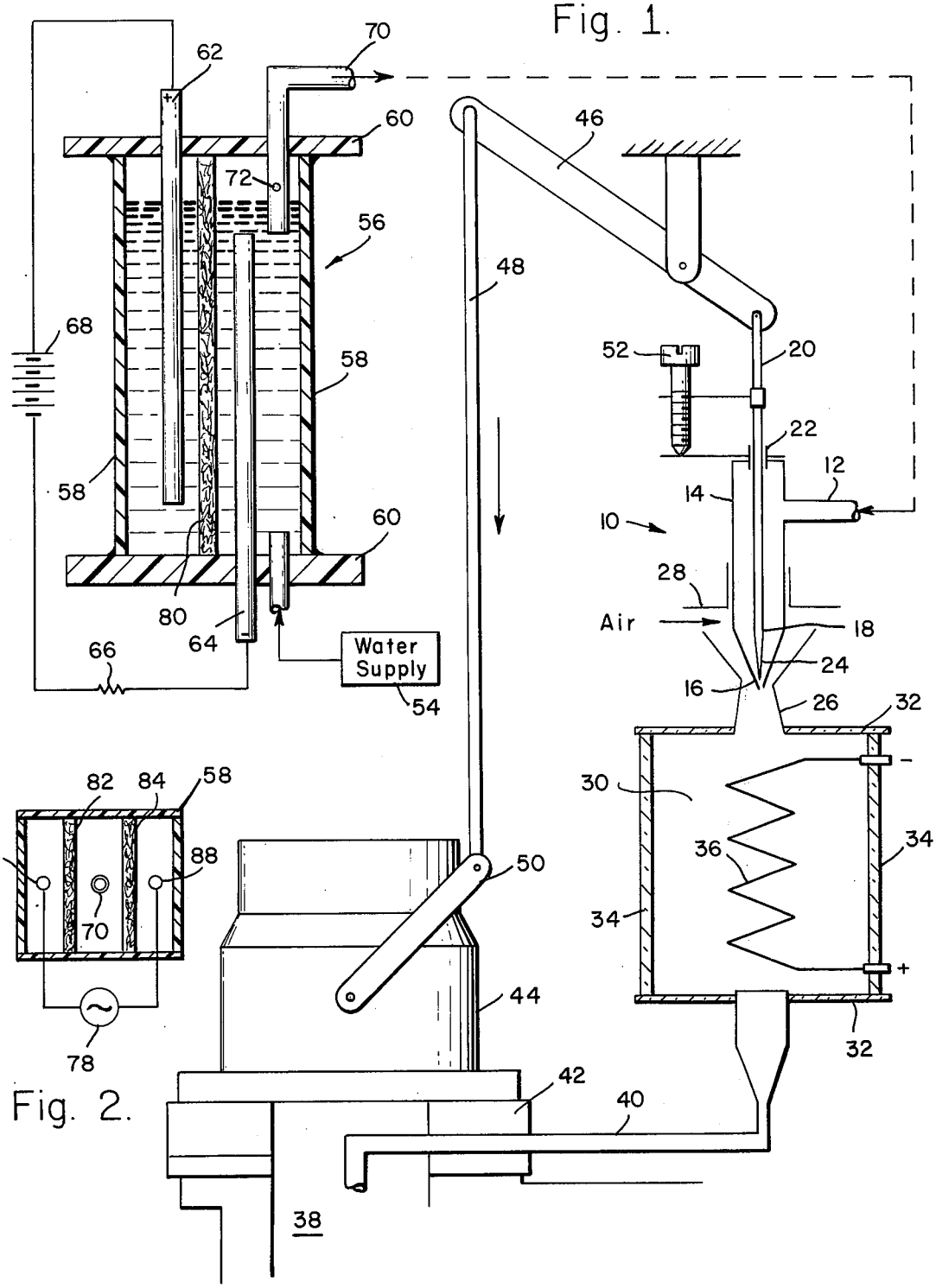
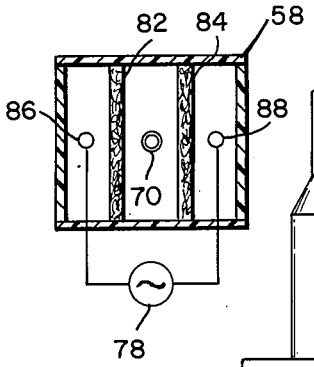
Fig. 2.

ANTIPOLLUTION CARBURETOR DEVICE FOR INTERNAL COMBUSTION ENGINES

CROSS-REFERENCE TO RELATED INVENTIONS

This is a continuation-in-part of copending application Ser. No. 366,270, filed June 4, 1973 and now abandoned.

BACKGROUND OF THE INVENTION

1. Field of the Invention

The present invention relates to a device and process by which water, with chemical additives, is combined with fuel in an internal combustion engine to maximize complete combustion. The combination is preferably obtained by means of a water injector working in a vacuum atomizer.

2. Description of the Prior Art

Devices for controlling atmospheric pollutants from internal combustion engines are well-known and have taken a multitude of configurations. One especially popular form is the addition of water to fuel in order to increase the efficiency of combustion, so that the by-products thereof contain greater quantities of, for example, carbon dioxide than carbon monoxide. However, a simple addition of water has not solved all problems. For example, although the combustion products have shown a decrease in pollutants, the efficiency of converting fuel to the distance driven (e.g., in terms of miles per gallon) has decreased, or at least, has not exhibited an appreciable increase.

Furthermore, mixing of the water with the fuel must be such as to obtain the maximum results, as well as obtaining the most advantageous point of mixing. It is desired that the water be broken into its smallest component, such as by atomizing or spraying, and generally this is accomplished shortly after carburetion, just prior to supplying the mixture to the cylinders for ignition.

However, it is evident that the most efficient method has not yet been devised, because of the large number of propositions recently submitted in the literature.

SUMMARY OF THE INVENTION

Accordingly, the many problems and/or disadvantages of prior art devices are avoided and/or improved upon by proportionally combining an air-fuel mixture from the carburetor with vaporized water and chemical additives. As a result of fuel ignition within the cylinders of the engine, the water is converted into steam to encourage the production of carbon dioxide, simultaneously reducing the amount of carbon monoxide. Some hydrogen is produced in the process, which further aids in combustion. The chemical additives include both hydrogen- and oxygen-producing compounds, as well as catalyzers to aid the reactions involved in combustion.

It is, therefore, an object of the present invention to provide means and method for reducing atmospheric polutants from internal combustion engines.

Another object is the provision of means and method for enhancing fuel combustion in such engines, thereby reducing or substantially eliminating byproducts, including carbon monoxide and oxides of nitrogen and sulfur.

Another object is to provide means and method for retarding combustion of lubrication oil which cannot burn in the presence of steam, thereby effectively eliminating free carbon and smoke from exhaust emissions.

Another object is the provision of means and method for avoiding the need for leaded fuels.

Another object is to provide means and method for enlarging the number of anti-detonants, because more anti-detonants are soluble in water than in gasoline.

Another object is the provision of means and method for enabling lower engine temperatures.

Other characteristics and advantages, as well as a more complete understanding of the present invention may be obtained from the following description and accompanying drawings and are related to different methods of accomplishment of the invention, given as examples without limitations.

DESCRIPTION OF THE DRAWINGS

FIG. 1 is a schematic diagram showing an injection process for mixing water with additives therein with fuel and with an electrolysis apparatus for adding metallic salts to the water; and FIG. 2 depicts another embodiment of that shown in FIG. 1, utilizing alternating current.

DESCRIPTION OF THE PREFERRED EMBODIMENT

As shown in FIG. 1, an injection system 10 includes a conduit 12 connected to a cylindrical tube 14 terminating in a conical aperture 16. Centrally positioned within tube 14 is a needle 18 having one end 20 extending out of the tube at support 22 and a conical tip 24 slidable into conical aperture 16. Water, such as tap water, with dissolved additives therein enters tube 14 through conduit 12 and is metered through aperture 16 past needle tip 24. Aperture 16 occupies the center of a venturi 26 into which air is fed through an entry 28 for atomizing the water as it passes through aperture 16. Venturi 26 opens into a chamber 30 for receipt of the atomized water. Chamber 30 may be advantageously constructed by a pair of end plates 32 closing off a tube 34. Tube 34 may be made of material such as pyrex to permit the visual evaluation of the atomized water therein. The transparent chamber may contain a filament 36, such as of platinum, which is heated by the current of the automobile battery. The filament, when heated to approximately 800° C, insures the pre-heating and homogenization of the atomized water before it enters a motor 38. Although use of the filament is not essential for operation of the present invention because it does not cause any change in the composition of the exhaust, its use is preferred so that precise setting of the atomizer is not required.

The atomized water entering the venturi passes through a conduit 40 supported by a plate 42 into the motor, which is placed beneath a carburetor 44. Plate 42 may be constructed of aluminum and have one or more openings for the purpose of accommodating the use of many other accessories, such as windshield washers, wipers, depression-contact switches, ect. It is advantageous to place injector 10 as close as possible to plate 42.

Conical tip 24 of needle 18 is coupled to and under the control of the accelerator by a linkage comprising lever 46 connected to needle end 20, rod 48, and a link 50 secured to the butterfly valve of carburetor 44. The length of the conical needle tip must be equal to the total course of depression of the accelerator. The ratio between the course of the accelerator and tip 24 of the needle can be set by adjusting the connection of lever 46 between rod 48 and needle end 20. At idling of the motor, the needle is designed to substantially close conical aperture 16 to prevent the admission of water to the engine except for a small amount of leakage equivalent to about 1% of the weight of the gasoline. The samll amount of water may be leaked into chamber 30 along a small channel along the surface of the conical point. Instead of this small channel, this amount of water can be obtained by adjustment of micrometric screw 52, to avoid complete closing of the orifice of the conical point.

Thus, the quantity of water emitted from the injector controlled by a cone-shaped presettable needle is thereafter governed and regulated by the accelerator. The cone-shaped needle controls the amount of water, varying between 1% and 10% of the volume of the gasoline that is furnished by the carburetor.

The water for injection may be obtained from a tank 54 which preferably has a minimum capacity of 10% to 15% of the capacity of the gas tank. The water tank may be made of plastic or other resilient material with enough flexibility to accommodate expansion of water in case of freezing. A filter with a screen of metal, for example, is placed in the tank to strain any foreign particles from the water. This water may have additives already mixed therein for direct supply to injection system 10, or may be without additives and furnished to air electrolysis cell 56 which, in turn, is coupled to system 10. The operation of cell 56 will be explained in greater detail shortly.

When the motor is stopped, the water returns to the tank, which may be placed four inches below the injector, and close to and on the exhaust side of the motor so that in case of freezing, the vapor tension of the ice is enough to provide sufficient moisture for the idling of the motor, and the proximity of the exhaust provides heat to melt the ice.

Instead of preheating of the water by the use of the filament, the water can be passed through a few turns of copper tubing which is around the exhaust pipe and which leads from the plastic water tank to the atomizer. The number of turns of copper tube should be sufficient to heat the water to about 80° C. However, any production of vapor which would interrupt the delivery of water by producing a vapor lock in the copper tube must be avoided.

The injection of water permits the subtraction at the temperature of explosion, of a sufficient amount of calories for transforming the water into steam, and thus encourages the production of carbon dioxide while, at the same time as a corollary, reduces the production of carbon monoxide. In addition, a portion of the steam is decomposed by the action of the pressure and temperature of the explosion in the cylinder in accordance with the formula $$CO + H_2O = CO_2 + 2H.$$

To provide additional oxygen and hydrogen for the combustion, chemicals are added to the water, with further inclusion of a small percentage (0.01 per thousand to 1.0 per thousand ) of metallic salts to maximize performance. Such metallic salts include for example, but not by way of limitation, nickel carbonyl [$Ni(Co)_4$] or nickel protoxide [$Ni_2O_3$] in ammonium solution, cobalt carbonyl [$CO(CO)_4$], cobalt amine (the salts of cobalt which combine with ammonia to give numerous complex compositions) or a combination thereof. These salts aid in catalyzing the reaction during the combustion. The addition of other chemicals in the water is for the purpose of providing a free amount of hydrogen and oxygen to work under the control of the catalyzer for the purpose of achieving maximum combustion. These chemicals are selected on the basis of their containing elements which decompose easily under the temperature of the explosion and which are soluble in water. By way of example and not by way of limitation, such chemicals include hydrogen peroxide, ammonia, ethylene oxide, ethylene glycol, several members of the family of methyl and ethylamine, or a combination of those chemicals.

The analysis of the exhaust that results from the injection into the cylinder of water already combined with its chemical additives shows a mixture of carbon dioxide and steam, a small percentage of carbon monoxide, and no appreciable quantity of nitrate product.

The catalyzation of the residual carbon monoxide and sulfur is made easier to obtain in steam atmosphere, at a temperature of over 200° C, and in the presence of metallic catalyzers.

In addition, because lubricating oil does not burn in the presence of steam, the exhaust emissions have no trace of free carbon or smoke.

Furthermore, the presence of water, by reason of its anti-explosion power, permits the use of non-leaded gasoline.

Very few anti-detonants can be added to gasoline because of the incompatability of most anti-detonants. But by contrast, a great number of anti-detonants can be mixed with the injected water. For example but not by way of limitation, 0.5% of ethylene glycol mixed in with the injected water allows the use of non-leaded gasoline in a racing motor having a compression ratio of 9.5 and more.

The motors using injection of water show a lower than normal operating temperature because of the evacuation of calories being facilitated by the high thermal conductivity of water.

Although the various additives may be included in the tap water as salts, it is possible to avoid the need for salts for solvency purposes by placing such additives directly into the water, such as by use of electrolysis cell 56 connected between tank 54 and injector 10.

The electrolysis cell comprises a tube 58, such as of pyrex, and two lids 60 of plastic having a high melting point, such as of nylon. The cell includes two electrodes 62 and 64 configured as two metal plates or rods having a preferred minimum surface area of 3 square inches. The electrodes are selected from the family of metals capable of acting as catalyzers, such as platinum, paladium, nickel, cobalt, cadmium, and chromium. Examples of such electrode combinations include electrodes of nickel and platinum, electrodes of nickel and cobalt, and several alloys which include nickel and chromium within their composition, such as nickel-chromium, monel metal, invar, and constantan.

The cell is connected by a current limiter 66 with a maximum of 0.5 amperes to the battery 68 of the automobile, or if the automobile has an alternator, preferably thereto, because with alternating current the electrodes are used with more uniformity.

Cell 56 is filled with water from tank 54. Ordinary tap water is sufficiently conductive to start the electrolysis of metals, because of the presence in the water of chlorine or other conductive matter. If the water is too pure, such as distilled water, the electrolysis can be started with a pinch of washing powder or soap. The electrolytic action causes metal from the electrodes to react with the minerals already in solution. The water from the cell passes therefrom through a tube 70 to conduit 12. Tube 70 therein a small hole 72 near the water level (⅛ inch above the level) to permit escape of electrolysis gas and the formation of water and gas bubbles.

A porous diaphragm 80 may be placed about anode electrode 62 to avoid possibilities of clogging, especially after a period of time when the engine and the liquid of cell 56 have had a chance to cool. It has been found that the liquid contents tend to flocculate; that is, to gel or make a flux-like material when it cools, which tends to plug up the injector. This gel tends to concentrate about anode 62; therefore it is preferred to isolate the anode from the opening 72 to tube 70, thereby maximizing flow of water and decreasing any impediments to its flow through cell 56. Diaphragm 80 is made porous by constructing it of cotton, felt, or preferably fiber glass held between two sheets of perforated plastic.

When the current is not direct current, as shown in FIG. 1, but alternating, energized by a source 78, the construction of FIG. 2 is used. In this case, two diaphragms 82 and 84 are employed to retain any flocculants at both anodes 86 and 88.

Water coming out of the cell has a very high catalyzing property and, when injected into the motor, may be disassociated into hydrogen and oxygen at the temperature and pressure of the explosion. The small amount of catalyzing metal that is liberated during this disassociation also catalyzes the combustion of the gasoline by changing carbon monoxide to carbon dioxide, or into methane ($CH_4$), depending upon the temperature and the choice of metal electrode. For example, electrodes of nickel provide methane below 400° C and cobalt-cadmium provides carbon dioxide below 300° C. The hydrogen and oxygen that is liberated by the electrolysis provides additional capability of achieving maximum combustion.

It is advantageous to increase the production of hydrogen in electrolysis cell 56 for the purpose of increasing the catalyzing action of the catalyst and, consequently, to encourage greater conversion of carbon monoxide into methane. Such increased hydrogen production is enabled by increasing the potential applied to electrodes 62 and 64. A potential sufficient for this purpose is from 12 volts to 80 volts AC which may be obtained, for example, by use of a solid state AC converter having a capacity of 40 watts or by use of a step-up transformer coupled to the automobile alternator. In a similar manner, if the power applied is direct current, the increase in potential is achievable by a DC to DC or DC to AC converter, depending upon whether the desired output is direct or alternating current.

Although the invention has been described with reference to particular embodiments thereof, it should be realized that various changes and modifications may be made therein without departing from the spirit and scope of the invention.

What is claimed is:

1. In an internal combustion engine, the improvement in improving the combustion of a hydrocarbon fuel-air mixture in the engine comprising means for defining a water-soluble catalytic agent and means for supplying water with said catalytic agent means dissolved therein from a source to the fuel-air mixture prior to supply thereof to the engine for enhancing combustion of said hydrocarbon fuel and for controlling the products of combustion thereof.

2. The improvement as in claim 1 wherein said water supplying means includes a vacuum atomizer for premixing said water with air as a water-air vapor prior to supplying said water-air vapor to said fuel-air mixture.

3. The improvement as in claim 2 further including means for mixing additives in addition to said catalytic agent means with said water.

4. The improvement as in claim 3 wherein said additives include oxygen and hydrogen supplying chemicals to increase combustion.

5. The improvement as in claim 4 wherein said additives are selected from the group consisting of hydrogen peroxide, ammonia, ethylene oxide, ethylene glycol, members of the methyl and ethylamine compounds, and combinations thereof.

6. The improvement as in claim 1 wherein said catalytic agent means are selected from the metallic salts consisting of nickel carbonyl or nickel protoxide in ammonia solution, cobalt carbonyl, cobalt amine, and combinations thereof.

7. The improvement as in claim 6 further including means for defining oxygen and hydrogen supplying additives selected from the group consisting of hydrogen peroxide, ammonia, ethylene oxide, ethylene glycol, members of the methyl and ethylamine compounds, and combinations thereof.

8. The improvement as in claim 2 wherein said water supplying means further includes accelerator means coupled to said carburetion means for adjusting said water to air mixture.

9. The improvement as in claim 8 further including means for presetting the amount, of said water mixed with said air during idling of said engine.

10. The improvement as in claim 2 further including means for heating said water-air vapor prior to supplying said water-air vapor to the fuel.

11. The improvement as in claim 10 wherein said heating means is selected from means consisting of an electrically heated filament and a tubular heat exchange coil.

12. The improvement as in claim 1 further including means for coupling said fuel supplying means and said water supplying means for providing a proportionate water-to-fuel mixture.

13. The improvement as in claim 1 wherein said dissolved catalytic agent means includes non-toxic, anti-knock, and exhaust-cleaning means.

14. In an internal combustion engine, the improvement in improving the combustion of a fuel-air mixture in the engine comprising:

means for defining a water-soluble catalytic agent;

means for supplying water with said catalytic agent means dissolved therein from a source to the fuel-air mixture prior to supply thereof to the engine for enhancing combustion of said fuel and for controlling the products of combustion thereof; and a cell coupled to said water source and to said water supplying means, said cell comprising an enclosure coupled to said water source at an inlet and to said water supplying means at an outlet and filled with water, electrodes in said enclosure and in said water, and a source of power coupled to said electrodes for placing said catalytic agent means into said water.

15. The improvement as in claim 14 wherein said electrodes comprise platinum, paladium, nickel, cobalt, cadmium, and chromium.

16. The improvement as in claim 14 wherein said electrodes are selected from the pairs of electrodes consisting of nickel and platinum, nickel and cobalt, and alloys of nickel and chromium.

17. The improvement as in claim 14 further including a porous diaphragm separating at least one of said electrodes from said inlet and said outlet for decreasing any impediment from the flow of water between said inlet and said outlet.

18. The improvement as in claim 17 wherein said source of power is direct current and wherein said one electrode comprises an anode.

19. The improvement as in claim 17 wherein said source of power is alternating current and wherein said porous diaphragm separates both said electrodes from said inlet and said outlet.

20. The improvement as in claim 14 further including means for increasing the potential applied to said electrodes for increasing the production of hydrogen, thereby for augmenting catalization of carbon monoxide to methane.

21. The improvement as in claim 20 wherein said increasing means comprises a converter coupled to said source of power.

22. In an internal combustion engine, the improvement in improving the combustion of a fuel-air mixture in the engine comprising:

means for defining a water-soluble catalytic agent;

means for supplying water with said catalytic agent means dissolved therein from a source to the fuel-air mixture prior to supply thereof to the engine for enhancing combustion of said fuel and for controlling the products of combustion thereof;

said water-supplying means comprising an injector device having a tube having a conical mouth and a needle moveable therein to form therewith a needle valve, a venturi having said conical mouth positioned therein, and an air inlet positioned adjacent said venturi and said conical mouth to permit air to be drawn into said venturi;

means for supplying said fuel-air mixture and comprising a vacuum chamber and carburetion means including carburetion controlling means, said vacuum chamber having a coupling to said venturi; and means coupling said carburetion controlling means and said needle for simultaneously controlling said carburetion means and the position of said needle within said conical mouth.

23. The improvement as in claim 22 further including a heater in said water-supplying means connected to a source of electrical power.

* * * * *